United States Patent [19]

Kirkendall et al.

[11] 4,450,770

[45] May 29, 1984

[54] PIVOT RING FOR A DISCARDING SABOT

[75] Inventors: Richard D. Kirkendall, Havre de Grace; William H. Drysdale, Aberdeen; Louis D. Kokinakis, Fallston, all of Md.

[73] Assignee: The United States of America as represented by the Secretary of the Army, Washington, D.C.

[21] Appl. No.: 462,288

[22] Filed: Jan. 31, 1983

Related U.S. Application Data

[63] Continuation of Ser. No. 184,715, Sep. 8, 1980, abandoned.

[51] Int. Cl.[3] ..... F42B 13/16

[52] U.S. Cl. ..... 102/523; 102/524; 102/703

[58] Field of Search ..... 102/520–523, 102/524, 527, 528, 532, 703

[56] References Cited

U.S. PATENT DOCUMENTS

| | | | |
|---|---|---|---|
| 2,306,140 | 12/1942 | Reed | 102/522 |
| 2,348,675 | 5/1944 | Dodge | 102/528 |
| 3,262,391 | 7/1966 | Shober | 102/521 |
| 3,311,061 | 3/1967 | Roehrdanz | 102/523 |
| 3,620,167 | 11/1971 | Romer et al. | 102/521 |
| 3,738,279 | 6/1973 | Eyre et al. | 102/521 |
| 3,760,736 | 9/1973 | Eig | 102/527 |
| 3,834,314 | 9/1974 | Young | 102/703 |
| 3,899,978 | 8/1975 | Luther et al. | 102/521 |
| 4,029,018 | 6/1977 | Bjornson | 102/521 |

FOREIGN PATENT DOCUMENTS

| | | | |
|---|---|---|---|
| 2844870 | 5/1980 | Fed. Rep. of Germany | 102/529 |
| 123501 | 2/1919 | United Kingdom | 102/522 |
| 2033556 | 5/1980 | United Kingdom . | |

*Primary Examiner*—Harold J. Tudor

*Attorney, Agent, or Firm*—Robert P. Gibson; Anthony T. Lane; Harold H. Card, Jr.

[57] ABSTRACT

The invention is an improved means for the efficient discard of multi-segment sabots. The invention consists of a ring-like mechanism that holds the aft end of the sabot segments in place around the projectile. The ring-like mechanism also serves to seal the interface between the sabot and the projectile. In operation, after the projectile and sabot exit from the muzzle of the launch device, the ring-like mechanism acts as a hinge device which causes the individual sabot segments to pivot about their aft extremity and finally discard as the pivot ring releases.

8 Claims, 5 Drawing Figures

PIVOT RING FOR A DISCARDING SABOT

The invention described herein may be manufactured, used, and licensed by or for the Government for Governmental purposes without the payment to us of any royalties thereon.

This application is a continuation of application Ser. No. 184,715, filed Sept. 8, 1980, now abandoned.

BACKGROUND AND SUMMARY OF THE INVENTION

The invention relates to sabot devices for projectiles and in particular to multi-segment sabots. Specifically, the invention relates to a mechanism for the efficient discard of multi-segment sabots.

The multi-segment sabots with which the invention is concerned are those as are commonly used to obtain higher velocity or extended range for subcaliber projectiles.

In the prior art a discarding sabot is utilized to obtain increased performance from a subcaliber projectile. The improvement in performance occurs because the bore area on which the gun propellant pressure acts may be greatly increased with only a relatively modest increase in total projectile weight, while the small diameter flight body has low aerodynamic drag.

One type of sabot in the prior art consists of several segments that are fitted around a subprojectile, thus forming an annular ring which is discarded at muzzle exit.

The manner in which the discard of the sabot occurs is of crucial importance to the flight of the subprojectile. A poor discard, such as one which may be nonsymmetrical, too slow, nonuniform, or some other undesirable characteristic, may result in the physical impacting of the sabot and the flight body.

A poor discard may result in damage to the fin blades or other components, or in greatly increased initial yaw and yaw rate of the flight projectile. These effects are undesirable in that they increase drag and decrease the accuracy from levels which would otherwise be achievable.

In the prior art the most common method of augmenting the sabot discard process has been the use of the spin imparted to the projectile by the gun tube rifling. As soon as the projectile exits the muzzle, so that the gun tube no longer constrains the sabot, the centrifugal forces due to rotation of the projectile are converted to linear radial accelerations which initiate the motion of the sabot away from the subprojectile. At high spin rates this is an effective sabot discard method.

Many modern projectiles incorporate despinning obturators or other devices to eliminate the major part of the spin. For projectiles such as these, spin alone may not be a sufficient discard process. Obviously, this mechanism is also inappropriate in a smoothbore or unrifled gun tube, which does not impart spin to a projectile.

Another prior art discard mechanism in common use on modern projectiles is a front bourrelet break band. In practice this device consists of a metallic or plastics band located on the forward bore rider of the sabot. Notches are cut in the band at the sabot petal splits so that the band will break at a predetermined load.

In the operation of the front bourrelet break band, immediately after the projectile exits the muzzle, the band holds the front of the sabot together while the reverse gas flow from the muzzle blast and the sabot spin (if present) lift the rear of the sabot. After some predetermined amount of rear lift, the front band breaks, allowing the front of the sabot to begin lifting due to the aerodynamic forces. The resultant delay in front lift of the sabot is intended to give a more uniform sabot separation.

For sabots with extended rear tapers behind the obturating band, however, the reverse flow at the muzzle does not initiate rear lift to any appreciable extent, and the aforementioned front break band serves only to delay sabot separation.

A further disadvantage of a front break band arises because the load applied to the front of the sabot is dependent on the launch temperature. Hence, the front break band will not break at the same time in the discard cycle for the full range of launch conditions, making it impossible to attain optimum sabot discard for all temperatures.

In the present invention the mechanism consists of ring-like device that serves as a hinge means which causes the individual sabot segments to pivot about their aft extremity after muzzle exit in such a manner as to impart radial velocity to the sabot segment. The mechanism then releases the sabot when the attitude is such as to provide maximum aerodynamic lift to the sabot segments to enable a smooth and rapid discard to be effected.

The present invention, the ring-like device, in whatever form or configuration, connects the rear of the sabot to the subprojectile. This ring-like device may thus also function as a sealing device which prevents the leakage of propellant gas between the sabot and the subprojectile.

In operation, the ring-like device causes each sabot petal to pivot about its rearmost point immediately after the projectile exits the gun tube. This rotation or pivoting of the sabot petals is caused by the action of the aerodynamic forces on the forward sections of the sabot and the projectile spin, if present.

A band or other ring-like device keeps the aft section of the sabot petals in mechanical contact with the subprojectile, aft of its center of gravity, during the initial deployment of the petals. This mechanical contact, established by the band or ring-like device, during the initial deployment of the petals, is such that yawing motions are damped in the same manner as if a drag stabilizing chute were used.

The band or ring-like device is configured by notching so that it breaks after the sabot petals have rotated to the angle of attack which furnishes maximum aerodynamic lift to each petal. This high lift attitude, in conjunction with the initial radial motion of the sabot petal center of gravity due to rotation, separates the sabot petals from the flight body in a rapid and uniform manner.

As the fracture of the ring-like device is caused by rotation of the sabot petals and not by external forces, the ring-like device, or pivot ring, will break at the same point in the sabot discard cycle for all service temperatures, giving a dependable and consistant mechanism.

It is, therefore, an object of the invention to provide a mechanism for effecting the rapid removal of a sabot from its subprojectile.

It is another object of the invention to provide a mechanism that effects the rapid removal of a sabot from its subprojectile with minimal undesirable perturbations to the flight of the subprojectile.

It is also an object of the invention to provide a device for the positive sealing of the aft juncture of a sabot and a subprojectile interface against the hot propellant gases at launch.

It is still another object of the invention to provide a device for the positive sealing at the aft juncture of a sabot and a subprojectile interface against contaminants encountered during manufacture and/or storage.

It is yet another object of the invention to provide a means of partially damping the initial yaw rate acquired at muzzle exit so as to reduce the dispersion of the flight body.

It is also another object of the invention to provide a device for sabot separation which is not affected by the service temperature so that the sabot discard will be uniform and consistant through all operating ranges.

It is yet still another object of the invention to provide a device for sabot separation which is not affected by launch tube condition so that the sabot discard will be uniform and consistant.

Further objects and advantages of the invention will become more apparent in light of the following description of the preferred embodiments.

DESCRIPTION OF THE PREFERRED EMBODIMENTS

Figure 1:
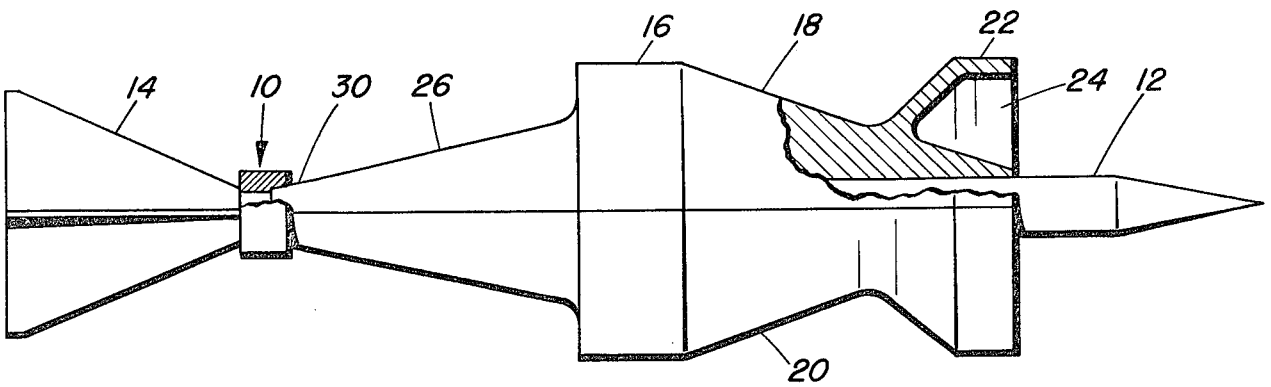
FIG. 1 is a side view of a subprojectile with a sabot mounted thereon and showing partial sections of the sabot and a pivot ring.
Figure 5:
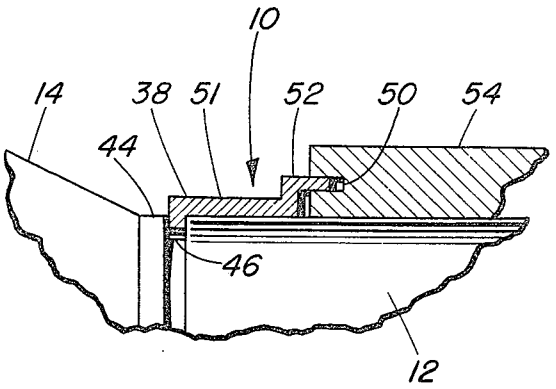
FIG. 5 is a partial cross sectional view of a third embodiment of a pivot ring for a discarding sabot.
Figure 4:
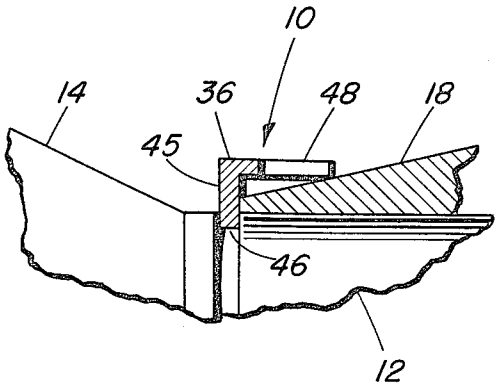
FIG. 4 is a partial cross sectional view of a second embodiment of a pivot ring for a discarding sabot.
Figure 3:
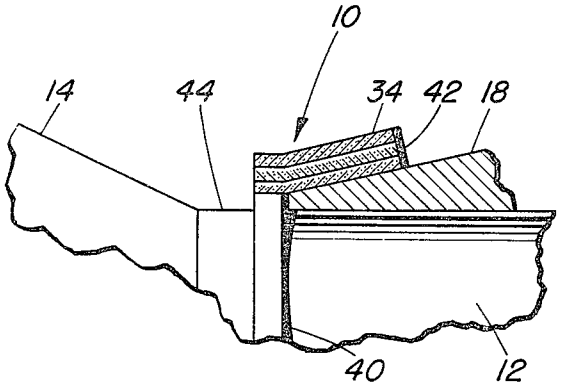
FIG. 3 is a partial cross sectional view of a first embodiment of a pivot ring for a discarding sabot.

Referring now to the drawings and particularly to FIG. 1, a pivot ring for a discarding sabot is shown at 10. Partial cross sections for first, second and third embodiments of a pivot ring 10 for a discarding sabot are shown in FIGS. 3, 4, and 5 will be described hereinafter in detail.

Referring to FIG. 1, a typical subprojectile 12, having flight stabilizing fins 14, has a typical sabot 16 mounted around the subprojectile 12. As shown in FIG. 1, the sabot 16 has at least two sabot petals 18 and 20.

It is to be understood that a typical sabot 16 may have a plurality of sabot petals similar to sabot petals 18 and 20, depending on the design of the segments or petals to surround the projectile involved.

The subprojectile 12 as illustrated may be a long cylindrical rod-like type, such as is commonly used as a kinetic energy penetrator, is stabilized in flight by the fins 14, however, it is to be understood that the type of subprojectile and the means of exterior flight stabilization is immaterial to this invention. Likewise, the type of sabot 16 may be varied. The typical subprojectile 12 and the typical sabot 16 illustrated are for purposes of describing the operation of the pivot ring 10 for a discarding sabot.

As illustrated in FIG. 1, the sabot 16 has a front borerider 22, which is used for support of the projectile in-bore and also provides a pocket 24 which furnishes aerodynamic forces when the projectile enters the free atmosphere after muzzle exit.

The same function of the front borerider 22 may be served by a long cylindrical skirt extending forward from the obturating band.

The sabot 16 as illustrated is a double ramp type, such as is used to achieve structural integrity and low parasitic mass. The sabot 16 as illustrated has a rear conical taper 26.

The pivot ring 10 is located at the rear end of the rear conical taper 26. In the three embodiments of the pivot ring 10, which will be described hereinafter, one of the embodiments will operate with no rear conical taper 26, such as might occur with some saddle type sabots.

Figure 2:
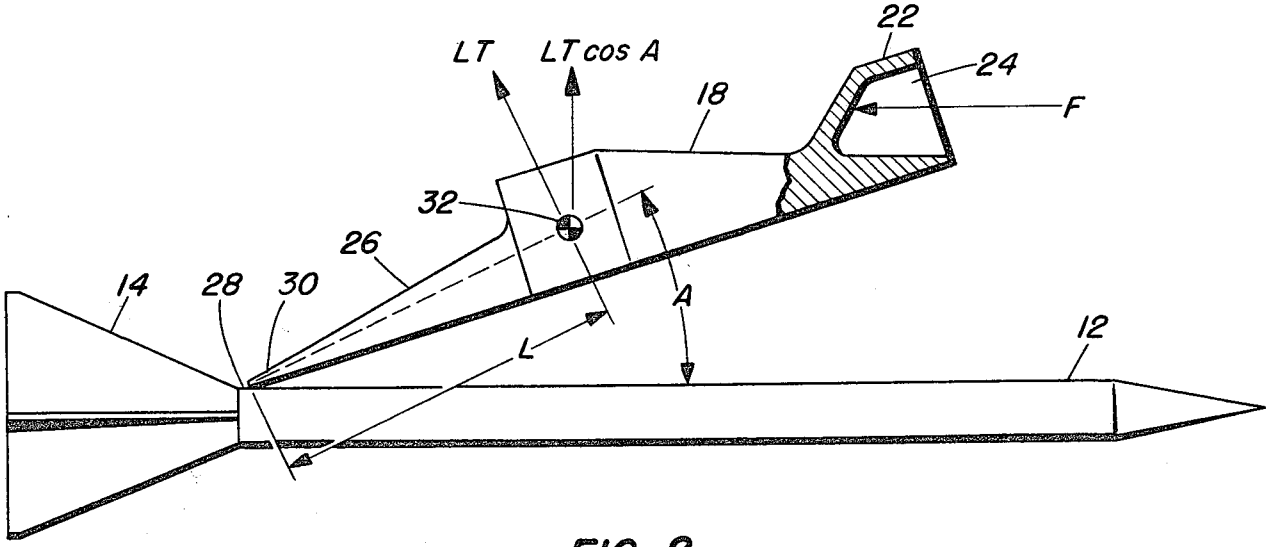
FIG. 2 is a side view of a subprojectile showing a sabot petal in partial rotation about a pivot point.

Turning now to FIG. 2, the operation of the pivot ring 10 for a discarding sabot is shown schematically. For purposes of discussion, the pivot ring 10 is not shown on FIG. 2, only the point of pivot 28 which the pivot ring 10 furnishes when it is in place. The operation is described using one sabot petal 18, however, the same description would apply to each sabot petal as it discards.

The pivot ring 10 restrains the aft end 30 of the sabot petal 18 during the period of reverse gas flow and depressurization at muzzle exit.

As the subprojectile 12 and its sabot 16 leave the muzzle, the aerodynamic forces against the pocket 24 of the sabot petal 18 (and the same occurs in other sabot petals) begins to lift the sabot petals 18 from the subprojectile 12. The aft end 30 of the sabot petal 18, being restrained by the pivot ring 10, as hereinafter described, pivots about the pivot point 28 as the sabot petal 18 begins to lift or rotate about the pivot point 28.

An effective force F is applied at the center of pressure by the aerodynamic pressure acting on the pocket 24 within the borerider 22 of the sabot petal 18. As noted, the same action takes place in other petals of the sabot 16.

For all practical configurations of the front borerider 22 and the pocket 24, the force F provides a movement about the pivot ring 10 at the pivot point 28 which causes the sabot petal 18 to begin lifting at the front and rotating about the pivot point 28.

Referring again to FIG. 2, the angle A is measured from the sabot 16 subprojectile 12 interface to the instantaneous location of the center of gravity 32 of the sabot petal 18, as the angle A increases, large areas of the sabot 16 on the several faces of the sabot petals (the faces which interfaced with the projectile, and the faces on the sides of the sabot petals which interfaced with each other) become exposed to air pressure, greatly increasing the magnitude of the force F as well as altering its location and direction.

As the center of gravity 32 rotates about the pivot point 28 of the pivot ring 10, with the lever arm L, its velocity is LT (where T is the time rate of change of A). The component of this velocity in the radial direction, which it is desired to maximize, is LT Cos A.

When the sabot petal 18 (as well as the other sabot petals) has rotated into a position such that the aerodynamic lift forces acting on the petal and the initial radial velocity are in such a combination to give the optimum sabot discard, the pivot ring 10 will release and allow the sabot petal 18 (and the other petals) to separate. At present, this optimum angle, A (Release), is determined experimentally.

Up to the time of sabot petal 18 release, the aerodynamic force F is applied through the pivot ring 10 to the rear of the subprojectile. The resultant of the force F from all of the petals of sabot 16 acts in the axial direction aft of the center of gravity of the flight projectile and creates a restoring moment which tends to dampen any yaw or yaw rate acquired by the projectile at muzzle exit.

Turning now to FIGS. 3, 4, and 5 for three embodiments of the pivot ring 10, a first embodiment 34 is shown in FIG. 3, a second embodiment 36 is shown in FIG. 4, and a third embodiment 38 is shown in FIG. 5.

The first embodiment 34 provides an integral ring-like land or separate ring-like or ring 40 affixed to and around the subprojectile 12 close to the fins 14. The rearward end of sabot petal 18 (and the other petals) rest against the land or separate ring 40. The sabot petal 18 (and the other petals) are constrained to rotate or pivot on the land or separate ring 40 by at least one or a sufficient number of layers of reinforcement type tape or other similar material 42, thus constricting the rear end of the sabot petal 18 (and the other petals of the sabot 16). The land or ring 40 may be held in place by the fin 14 hub 44 or by other suitable means.

The layers of reinforcement tape 42 and the separate ring 40, in combination, form the first embodiment 34 of the pivot ring 10 of this invention. Without these layers of reinforcement tape 42 constraining the premature radial motion of the rear of the sabot 16 during depressurization at muzzle exit, the rear edge of the sabot 16 could jump over the pivot land or separate ring 40 surface.

The layers of reinforcement tape 42 also serve as the aforementioned sealing means or device which prevents the leakage of propellant gas between the sabot 16 and the subprojectile 12 at the land or ring 40.

The second embodiment 36 provides a metallic or other suitable material pivot ring-like or ring 46 which is "L" shaped in cross-section. The pivot ring 45, "L" shaped in cross section, is cylindrical-like and held in place axially by the fin 14 hub 44 or by the interior leg of the "L" shaped ring in a shallow groove 46 in the subprojectile 12. The arrangement of ring 45 and groove 46 also serves as the aforementioned sealing device at each sabot petal 18.

When the fin 14 hub 44 is used to retain the "L" shaped pivot ring 45 in place, the shallow groove 46 is only a partial groove as the fin 14 hub 44 serves as the rearmost side of the groove 46.

The rearward end of sabot petal 18 (and other petals) rests against the pivot ring 45 on the inside of the cylindrical-like configuration.

The sabot petal 18 pivots about the pivot ring 45 in the second embodiment 36. Slots 48 may be cut at regular intervals, depending on the number of sabot segments, in a fore and aft direction in, and around the exterior leg of the "L" shaped pivot ring 45 in order to obtain the desired break strength in the remaining web.

The third embodiment 38 provides a metallic or other suitable material pivot ring-like or ring 51 where a sabot 54 has a rearward face which is a flat surface and may extend from the subprojectile to the bore surface of the launcher.

The third embodiment 38 is also cylindrical-like, but of two concentric "L" shaped cylindrical-like components that are integral with each other. A forward projecting wall 52 of the pivot ring 51, fits into a concentric circular groove-like slot 50 cut into the rear face of the sabot 54. The other end of the pivot ring 51 is secured in a shallow groove 46 in the subprojectile 12 or may be secured in place by the fin 14 hub 44 as in the second embodiment. The arrangement of the ring 51 and grooves 46 and 50 also serves as the aforementioned sealing device in a manner similar to the arrangement in the second embodiment.

It is to be understood that the aforementioned pivot ring-like means 40, 45, and 51 may be in one piece or composed of at least two parts and suitably joined together as a single ring-like means.

By the use of the pivot ring 10 of this invention it is possible to obtain a device for the uniform discard of multi-segment sabots over the complete range of operating conditions. Since the discard process of the sabot determines the initial conditions, in terms of yaw and yaw rate, of the exterior ballistic flight of the projectile, the consistency and uniformity of discard has major impact on the accuracy obtainable from the projectile system.

The invention is, in combination, a mechanism in pivot ring configuration for providing a pivot hinge at the aft end of each petal of a multi-segment sabot for the purpose of effecting the rapid removal of the sabot while causing minimal disturbances to the flight of the subprojectile.

The mechanism constrains the aft end of the sabot about the pivot due to the aerodynamic pressure applied to the front of the sabot, thus imparting an initial radial velocity to the center of gravity of the petal.

After some angle of sabot opening, chosen to yield the combination of initial radial velocity and angle of attack of the sabot petal in the free atmosphere which minimizes dispersion of the subprojectile, the mechanism releases the petal and allows the sabot to separate.

The aforementioned mechanism attaches firmly to both the aft end of the sabot and the subprojectile, thus effecting a gas pressure seal of the aft end of the sabot/-subprojectile interface to eliminate any potential leakage under the sabot petals.

As described hereinbefore, the mechanism maintains mechanical contact of the sabot petals and subprojectile during the initial opening phase, thus transferring the combined aerodynamic drag of the opening sabot to the aft of the flight projectile, where it acts as a drag stabilizer to damp the initial yaw and yaw rate.

The device imparts an initial radial velocity to individual sabot petals by fixing one end and allowing rotation about this hinge-like fixation, so that the center of gravity of the petal is accelerated away from the subprojectile.

The device constrains the sabot petals to undergo rotation while still attached to the projectile and then releases the petals after they have rotated to the angle of attack with the free stream atmosphere which provides maximum aerodynamic lift, thus providing a smoother and more rapid discard for the sabot.

As can be readily understood from the foregoing description of the invention, the present structure may be configured in different modes to provide the ability for a pivot means for a discarding sabot.

Accordingly, modifications and variations to which the invention is susceptible may be practiced without departing from the scope and intent of the appended claims.

We claim:

1. A mechanism for controlling the discard of a sabot from a subprojectile, said sabot having a forward end including a pocket and a rearward end and having at least two components, said sabot having a maximum outside diameter which comprises:

a separate ring-like holding means fixing the location of said sabot in peripheral pivotal contact at its rearward end with said subprojectile, and a groove-like means in and around the periphery of said subprojectile, for affixing said ring-like holding means thereto; wherein said ring-like holding means has a smaller diameter than said maximum outside diameter of said sabot and has an interior leg and an exterior leg, said exterior leg holding the rearward end of said sabot in contact with said subprojectile and said interior leg being disposed in said groove-like means, thereby sealing the interface of the rearward end of said sabot with said subprojectile to prevent leakage of propellant gases through said interface, whereby when the subprojectile and sabot leave the gun muzzle, aerodynamic forces act on the sabot pocket to lift the forward ends of the sabot components from the subprojectile, while the rearward ends of the sabot components are restrained against radial and axial movement by said ring-like holding means and pivot about said holding means.

2. The mechanism according to claim 1, wherein said ring-like holding means is substantially "L" shaped in cross-section, the legs of said "L" shape forming said interior and exterior legs.

3. The mechanism according to claim 2, wherein said ring-like holding means is metallic.

4. The mechanism according to claim 3, wherein additionally a plurality of slots are cut in a fore and aft direction in said exterior leg of said "L" shaped ring-like holding means to facilitate the break strength in the remaining web to effect said discard.

5. The mechanism according to claim 3, wherein said sabot rearward end has a conical taper and the exterior leg of said ring-like holding means contacts the periphery of said conical taper.

6. The mechanism according to claim 3, wherein the rearward face of said sabot contains a concentric slot and the exterior leg of said ring-like holding means is disposed in said slot.

7. The mechanism according to claim 6, wherein said holding means consists of two concentric, integrally joined, cylindrical-like components, each component being "L" shaped in cross-section, wherein an interior leg of one component projects inwardly and into said subprojectile groove-like means and an exterior leg of the other component projects axially at a right angle thereto and into said sabot concentric slot.

8. The mechanism according to claim 1, wherein said subprojectile comprises flight-stabilizing fins including a fin hub and said hub is the rearmost side of said groove-like means.

* * * * *

UNITED STATES PATENT AND TRADEMARK OFFICE

CERTIFICATE OF CORRECTION

PATENT NO. : 4,450,770

DATED : May 29, 1984

INVENTOR(S) : Kirkendall, Richard D.; Havre de Grace; Drysdale, William H.; Aberdeen; and Kokinakis, Louis D.; Fallston, all of Md.

It is certified that error appears in the above—identified patent and that said Letters Patent is hereby corrected as shown below:

Inventors: Richard D. Kirkendall, Havre de Grace;
William H. Drysdale, Aberdeen;
Louise D. Kokinakis, Fallston, all of Md.

Signed and Sealed this

*Twelfth* Day of *February 1985*

[SEAL]

*Attest:*

DONALD J. QUIGG

*Attesting Officer* *Acting Commissioner of Patents and Trademarks*